US009470061B2

(12) United States Patent
Sjostedt

(10) Patent No.: US 9,470,061 B2
(45) Date of Patent: Oct. 18, 2016

(54) HIGH STRENGTH CONNECTION FOR SLEEVE AND MANDREL AND RELATED METHODS

(71) Applicant: CCDI Composites Inc., Santa Ana, CA (US)

(72) Inventor: Rob Sjostedt, Foothill Ranch, CA (US)

(73) Assignee: CCDI Composites Inc., Santa Ana, CA (US)

( * ) Notice: Subject to any disclaimer, the term of this patent is extended or adjusted under 35 U.S.C. 154(b) by 343 days.

(21) Appl. No.: 14/168,761

(22) Filed: Jan. 30, 2014

(65) Prior Publication Data

US 2014/0209294 A1 Jul. 31, 2014

Related U.S. Application Data

(60) Provisional application No. 61/758,561, filed on Jan. 30, 2013.

(51) Int. Cl.
*E21B 33/134* (2006.01)
*E21B 33/128* (2006.01)

(52) U.S. Cl.
CPC ..... *E21B 33/134* (2013.01); *E21B 33/128* (2013.01); *Y10T 156/1057* (2015.01); *Y10T 156/1064* (2015.01); *Y10T 428/13* (2015.01)

(58) Field of Classification Search
CPC ..... E21B 33/128; E21B 33/134
See application file for complete search history.

(56) References Cited

U.S. PATENT DOCUMENTS

2013/0327517 A1* 12/2013 Good, III ..... E21B 33/12 166/192

* cited by examiner

*Primary Examiner* — William P Neuder
(74) *Attorney, Agent, or Firm* — Klein, O'Neill & Singh, LLP

(57) ABSTRACT

Device, system, and method to adhesively bond a sleeve to a mandrel are disclosed. The sleeve and the mandrel may be used as part of frac plug or a bridge plug in oil and gas applications. The bonded adhesive connection with grooves is strengthened to reliably achieve higher levels of lap shear strengths than attainable by conventional means.

20 Claims, 5 Drawing Sheets

HIGH STRENGTH CONNECTION FOR SLEEVE AND MANDREL AND RELATED METHODS

BACKGROUND

In oil and gas well completion operations, frac and/or bridge plugs are necessary for zonal isolation and multi-zone hydraulic fracturing processes. The advantages of frac and bridge plugs made primarily from composite materials is well established since these products significantly reduce drill-out (removal) time compared to drill out time for predominantly metal frac and bridge plugs. As drilling for oil and gas extends deeper and/or fracking pressures increase, composite frac and bridge plugs are subject to higher pressures and operating temperatures. With higher pressures and operating temperatures, increased stresses can be expected on frac and bridge plug products resulting in a corresponding need to engineer higher grade components, which can also mean increased in manufacturing costs. But as use of composite frac and bridge plug products increases, end users expect a corresponding decrease in costs.

Typical frac and bridge plugs can have upper and lower sleeves that are mounted or connected to a tubular central mandrel. For different manufacturers, the upper and lower sleeves may have other names or references, such as being called upper and lower support members, retaining bands, and loading rings. In general, the upper and lower sleeves retain the plug packing elements and slip elements in between the two sleeves to both lock the plug to the well pipe casing and seal the casing so hydraulic fracking pressurization requiring well isolation can occur. For a bridge plug, the mandrel is blocked from flow in either direction through the bore of the mandrel. In practice, this can be accomplished by providing a mandrel with a solid core or by closing the bore of the mandrel with an internal plug. For a frac plug, a closing ball is typically dropped to block the bore of the mandrel to isolate higher pressure above the frac plug from a lower pressure below. As readily understood, a cost effective but reliably strong upper and lower sleeve connection scheme for composite frac and bridge plugs is highly desirable.

When a frac or bridge plug is "set" in the well pipe casing, slips engage the casing and wedge the plug in place. Additionally, the rubber packing element is compressed axially to expand radially outwardly of the mandrel to seal against the casing inner wall. When the frac ball or closing ball is dropped for a frac plug, or when a bridge plug is set and the well is pressurized, the composite plug must withstand injection pressures as high as 8,000 psi, 10,000 psi, or even 15,000 psi depending on the well project.

The connection of the composite upper sleeve to the mandrel is what prevents the closing ball and the mandrel that it seats against from slipping past the packing element and slip components. The upper sleeve is the primary restraint that prevents the frac plug mandrel from being pushed or blown down the well casing. In the case of a bridge plug, both the upper sleeve and the lower sleeve experience a high force as pressure is reversed from above and below the plug. Consequently, a high strength connection of the sleeve and the mandrel is required for frac and bridge plugs.

A high strength connection is typically achieved by multiple mechanical shear pins or a combination of adhesive bonding and multiple mechanical shear pins between the sleeve and the mandrel. Mechanical shear pins are generally considered the most reliable way to achieve a high strength shear connection, although pins are considered labor intensive and costly. To form a pinned connection, multiple holes must be formed through the sleeve and the mandrel and then high strength composite or metal pins pressed in or glued in place in the drilled holes. Adhesive bonding with no pins can, in certain products, achieve the necessary strength for the application but has the potential of high variability part to part and the achieved strength is dependent on the adhesive bonding process.

Additionally, experience has shown that lengthening the sleeve and the mandrel overlap to provide added adhesive bond length between the two does not yield a linear increase in strength. Thus, a combination of adhesive bonding and mechanical shear pins is generally considered the more reliable sleeve to mandrel connection to date. Undesirably, the process of drilling the holes and installing the pins is time consuming and comes with a cost that is less desirous for users and consumers. Additionally, the holes drilled for pins are potential leak sites and points for hydrothermal degradation of the composite downhole plug.

SUMMARY

A method for increasing adhesive bond strength of a composite sleeve to a mandrel is disclosed. In one example, the method comprises providing a mandrel with a longitudinal axis, machining a plurality of grooves on an exterior surface of the mandrel along the longitudinal axis of the mandrel; and applying adhesive to the axial grooves. The method can further comprise placing the sleeve over the mandrel and allowing the adhesive to cure. In a particular example, the mandrel is made from a composite material.

A further aspect of the present disclosure is a method for distributing stress deeper into layers of a composite mandrel and a composite sleeve. The method can comprise the steps of machining a plurality of axial grooves on the surface of the mandrel; and placing the sleeve over the mandrel so that the sleeve overlies at least part of the axial grooves. In some examples, the sleeve is also grooved. Where the sleeve is groove, the grooves of the mandrel and of the sleeve can be nested, similar to two mating gears.

The method, wherein the sleeve is at least one of a frac plug sleeve and a bridge plug sleeve.

The method, wherein the grooves each has a dimension of about 0.040 inches wide.

The method, wherein the grooves each has a dimension of about 0.060 inches deep.

A still yet further aspect of the present disclosure is a method for enhancing lap shear strength of an adhesive bond between a composite sleeve and an elongated mandrel comprising a bore. The method comprises the steps of machining a plurality of grooves on an exterior surface of the mandrel along a longitudinal axis of the mandrel; applying adhesive to the axial grooves; and placing the composite sleeve over the mandrel.

The method can further comprise the step of forming a hole through the mandrel and a hole through the sleeve, aligning the hole in the sleeve with the hole in the mandrel, and placing a pin through the aligned holes.

The method, wherein the composite sleeve comprises one or more blown fiberglass roving strands formed on an interior surface of a bore, on an outside surface of the mandrel, or both.

A still further feature of the present disclosure is a method of increasing interlaminar shear strength of a filament wound sleeve of a downhole system. The method can comprise the steps of winding one or more blown roving strands that have catenary loops of fiber to bridge between filament wound layers of the sleeve; applying adhesive to the sleeve or to a mandrel; and attaching the sleeve to the mandrel.

The present disclosure further includes a method of making a secure structural connection, said method comprising machining a plurality of grooves on an exterior surface of the mandrel along a longitudinal axis of the mandrel; providing a sleeve comprising one or more blown roving strands that have catenary loops of fiber to bridge between filament wound layers of the sleeve; applying adhesive to the mandrel, to the sleeve, or both; and attaching the sleeve to the mandrel.

A yet further feature of the present disclosure is a method of making a secure structural connection. Said method can comprise the steps of machining a plurality of grooves on an exterior surface of the mandrel along a longitudinal axis of the mandrel; the grooves are positioned adjacent a plurality of ridges; machining grooves in the inside surface of a sleeve; the grooves are positioned adjacent a plurality of ridges; geometrically size the mandrel and the sleeve such that the grooves do not nest together or size the mandrel and the sleeve such that the grooves and the ridges of the sleeve and the mandrel nest together; and providing adhesive in a space between the sleeve and the mandrel.

Still yet another method is provided for increasing adhesive bond strength of a composite sleeve to a mandrel comprising a longitudinal axis. The method can comprise machining a plurality of grooves on an exterior surface of the mandrel along the longitudinal axis of the mandrel; applying adhesive to the axial grooves; and placing the sleeve over the mandrel.

The method wherein the mandrel may be made from a composite material.

The method can further comprise machining an inside surface of the sleeve with a plurality of grooves prior to placing the sleeve over the mandrel.

The method wherein the plurality of grooves on the mandrel can be equally spaced around the exterior surface.

The method can further comprise a ball seat at a first end of the mandrel.

The method wherein the grooves can each have a dimension of about 0.040 inches wide.

The method wherein the grooves can each have a dimension of about 0.060 inches deep.

Yet another aspect of the present disclosure is a method for enhancing lap shear strength of an adhesive bond between a composite sleeve and an elongated mandrel comprising a bore. The method can comprise machining a plurality of grooves on an exterior surface of the mandrel along a longitudinal axis of the mandrel, each of said grooves comprising a bottom surface, two sidewalls, a groove depth, and a groove width; applying adhesive to the axial grooves; and placing the composite sleeve over the mandrel and providing a clearance between an inside surface of the sleeve and the exterior surface of the mandrel.

The method can further comprise forming a hole through the mandrel and a hole through the sleeve, aligning the hole in the sleeve with the hole in the mandrel, and placing a pin through the aligned holes.

The method wherein the composite sleeve can further comprise a bore defining an interior surface comprising one or more blown fiberglass roving strands.

The method wherein the mandrel may be made from a composite material.

The method can further comprise placing a slip back up ring and a slip wedge onto the mandrel.

The method wherein the adhesive can extend beyond a first layer of fibers on the exterior surface of the mandrel along a length of at least four grooves.

Another feature of the present disclosure is an apparatus comprising a composite high strength structure comprising a composite mandrel comprising an elongated body comprising a length, an exterior surface, and a bore comprising an interior bore surface; a composite sleeve comprising an elongated body comprising a length, an exterior surface, and a bore comprising an interior bore surface placed over at least part of the exterior surface of the mandrel and defining an overlapped section; a plurality of spaced apart grooves located at the overlapped section, each of said groove comprising a length, a width, and a depth; and cured adhesive located in the plurality of spaced apart grooves.

The composite high strength structure can further comprise a slip back up ring, a slip wedge, and a packer ring located on the exterior surface of the mandrel.

The composite high strength structure wherein the plurality of grooves can be provided on the mandrel by machining the mandrel and on the sleeve by machining the interior bore surface of the sleeve.

The composite high strength structure wherein the plurality of grooves on the mandrel and the plurality of grooves on the sleeve can have different width, different depth, or both.

The composite high strength structure can further comprise at least one hole on the mandrel aligned with at least one hole on the sleeve and wherein a pin is located in the aligned holes.

The composite high strength structure can further comprise blown roving strands providing on the interior bore surface of the sleeve.

The composite high strength structure can be attached to an automobile as a torque tube.

BRIEF DESCRIPTION OF THE DRAWINGS

These and other features and advantages of the present device, system, and method will become appreciated as the same becomes better understood with reference to the specification, claims and appended drawings wherein:

DETAILED DESCRIPTION

The detailed description set forth below in connection with the appended drawings is intended as a description of the presently preferred embodiments of downhole tools and components for downhole tools provided in accordance with aspects of the present device, system, and method and is not intended to represent the only forms in which the present device, system, and method may be constructed or utilized. The description sets forth the features and the steps for constructing and using the embodiments of the present device, system, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Device, system, and method to adhesively bond a sleeve to a mandrel for frac and bridge plugs that reliably achieve a higher level of lap shear strength than attainable by conventional means are provided in the present disclosure. The disclosed device, system and method are configured to be used without mechanical shear pins by increasing the lap shear strength between the sleeve and the mandrel through a unique system of bonding. However, in alternative embodiments, shear pins may be incorporated in addition to the adhesively bonded frac and bridge plugs of the presently disclosed device, system and method. Further, while the disclosed connection between a sleeve and a mandrel is described for oil and gas downhole production, the present disclosure may be used for other applications, such as for a torque tube or a coupling to connect a driver to a driven device, such as in a cooling tower fan application or any tubular tension member made of overlapping tube elements.

Figure 1:
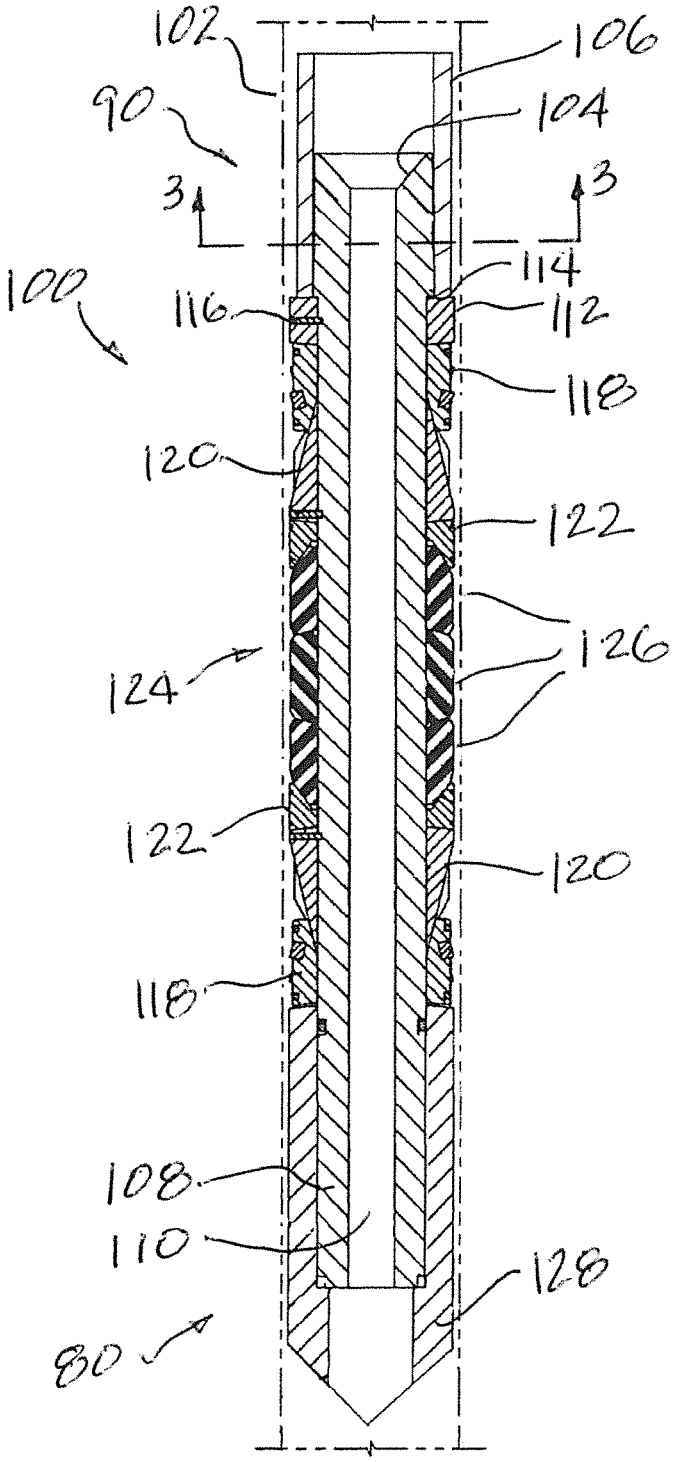
FIG. 1 is a schematic cross-sectional side view of a downhole tool provided in accordance with aspects of the present disclosure.

With reference now to FIG. 1, a downhole tool 100 provided in accordance with aspects of the present disclosure is shown situated in a well bore 102, which can be a production casing, an intermediate casing, or a surface casing. The downhole tool 100 is a frac plug system and includes a ball seat 104 for receiving a closing ball or frac ball (not shown). However, in other embodiments, the downhole tool can be a bridge plug that utilizes the high strength connection and system of bonding of the present disclosure.

As shown, the tool 100 has a first end 90 and a second end 80 and a mandrel 108 running through the tool. A sleeve 106 is shown attached to the mandrel 108, which has a bore 110 for fluid flow. In one example, the sleeve 106 is attached to the mandrel 108 without any pin, i.e., a pin-less connection. In alternative embodiments, one or more pins are used to secure the sleeve and the mandrel in combination with adhesive, as further discussed below. The sleeve and the mandrel may be made from a non-metallic material, such as a composite sleeve and/or composite mandrel.

A spacer ring 112 is abutted against a shoulder 114 defined by the sleeve 106 and optionally pinned to the sleeve with one or more pins 116. The spacer ring 112 supports a slip back up or slip ring 118, which has a tapered interior surface for riding up against a tapered surface of the slip wedge 120 to bite against the casing when set. A second set of slip wedge 120 and slip ring 118 is provided closer to the second end 80 for gripping the tool assembly 100 against the casing.

A packer shoe 122 is provided adjacent the packer assembly 124, which in the current embodiment has three packer rings 126. In other examples, a different number of packer rings is used, such as one, two, or more than three. The upper and lower packer shoes 122 are configured to compress the packer assembly 124 when the downhole tool 100 is set, which causes the three packer rings 126 to expand outwardly away from the mandrel 108 to seal against the casing.

A nose section 128 is provided at the second end 80 of the downhole tool 100, which may be used to engage a crown (not shown) of another downhole tool. In the present embodiment, the nose section 128 is attached to the mandrel 108 without any pin, i.e., a pin-less connection. In alternative embodiments, one or more pins are used to secure the nose section 128 and the mandrel in combination with adhesive, as further discussed below. In yet other examples, the nose section 128 is threaded to the mandrel 108.

Figure 2:
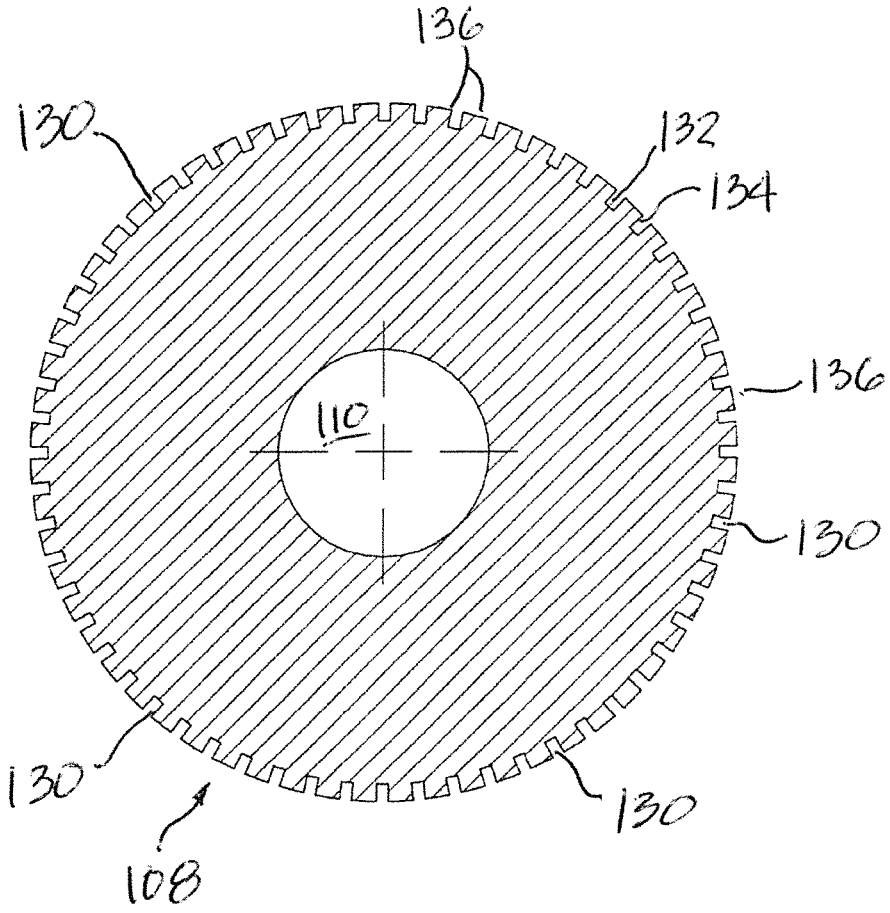
FIG. 2 is a cross-sectional end view of a mandrel in accordance with the system, device, and method of the present disclosure.

With reference now to FIG. 2, a cross-sectional end view of the mandrel 108 at a point within the overlapped section with the sleeve 106 is shown (shown without the sleeve 106). As shown, a plurality of grooves 130, which may be referred to as splines, are provided in or on the surface of the mandrel 108, which can be used for a bridge plug or a frac plug. The grooves or splines 130 are preferably formed along the axial direction of the longitudinal axis of the mandrel although radial rings, similar to recessed rings formed on the surface of the mandrel, are contemplated. As used herein with respect to the splines, the words "in" and "on" are used interchangeably unless the context indicates otherwise. The splines define surface areas for adhesive bonding, which are increased substantially over a mandrel with comparable outer diameter but with a smooth outer surface without formed grooves. In one example, standard overlapping between the sleeve and the mandrel in combination with the disclosed bonding technique is used.

As shown, the grooves are each about 0.040 inches wide and about 0.060 inches deep, although other groove geometries, such as semi-circular, function also. In some examples, the grooves can each embody geometry of about 0.035 to about 0.055 inches deep. In other examples, the depth should be limited to no more than 0.060 inches. In still yet other examples, the width is greater than 0.040 inches and the depth is greater than 0.060 inches, which can depend on the thickness of the mandrel used for the downhole tool. The spacing and size of each groove relative to an adjacent groove can vary although uniformity is preferred.

By machining a plurality of grooves on the outer surface of a mandrel, a typical 2.5 inch diameter frac plug mandrel will have an increased surface area for bonding. In one example, sixty (60) grooves are machined on the outer surface of a 2.5 inch diameter mandrel at roughly equally spaced apart distance from one another, which results in a bonding surface area that is approximately doubled over comparable smooth contours without any grooves. In an embodiment, the grooves are machined using a custom machine, such as CNC-based machining, with multiple diamond coated wheels cutting the grooves. Each groove 130 has a bottom wall 132 and two sidewalls 134 and is located between two adjacent external strips 136. In other examples, less than or more than sixty grooves are machined into the mandrel. In other embodiments, the gaps between the grooves can vary, i.e., not all are equally spaced apart.

Once the grooves are formed and adhesive is applied, the adhesive bond extends beyond the first layer of fibers on the surface of the mandrel and into the next deeper layers to increase the strength of the adhesive joint between the sleeve and the mandrel. This method, and the resultant product and system formed thereby, increases the lap shear strength for a frac or bridge plug sleeve 106 to mandrel 108 connection over what can be achieved by conventional bonding practices on simple cylindrical mandrels and sleeves. It is believed that by bonding the sleeve to the mandrel using the disclosed grooved mandrel, the connection has a lap shear strength of about 20% stronger than conventional bonding practices. Additionally, the grooved adhesive joint has been demonstrated to be more consistent in lap shear strength than conventional adhesive bonding practices because of the significant increase in bonding surface areas. In other words, the joint is operating at a lower shear stress level due to the increased in bonding surface areas.

To achieve even higher shear strength values when nesting the components together, splines may be formed inside the bore of the sleeve 106 in addition to forming splines on the mandrel 108, as further discussed below. This configuration resembles a gear mesh between two mating gears. Another approach to increasing the shear strength is to stop the machined mandrel splines just short of the first end of the mandrel 108 so that there is a wedge interference once the parts are joined and the adhesive cures.

Figure 3:
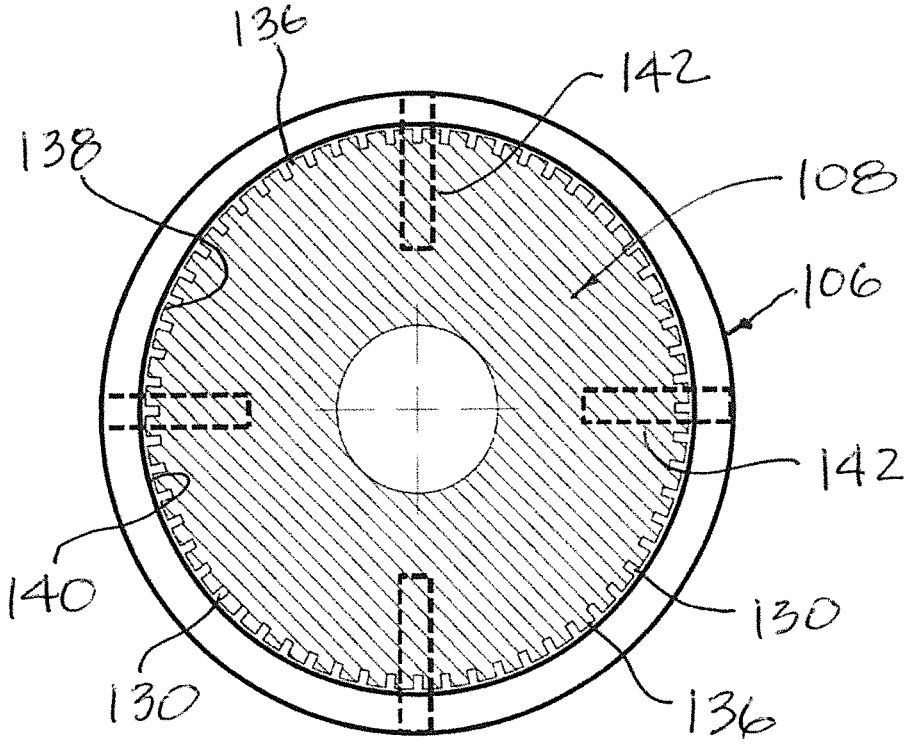
FIG. 3 is a cross-sectional end view of the mandrel and sleeve of FIG. 1.

FIG. 3 is a cross-sectional end view of the downhole tool 100 of FIG. 1 taken along line 3-3. In one example, the sleeve 106 inside diameter 138 is about 0.005 to 0.008 inches larger than the outside diameter of the mandrel 108. Thus, a gap of about 0.002 to 0.004 inches is provided between the inside surface 140 of the sleeve 106 and the external strips 136 on the mandrel 108. In other examples, the total clearance between the sleeve and the mandrel may be greater than 0.008 inches, such as up to about 0.015 inches and more depending on the diameter of the mandrel and the inside diameter of the sleeve. This clearance minimizes the possibility of wiping away any adhesive during assembly of the sleeve over the mandrel. Additionally, the depth of each groove 130 acts as a pocket for accommodating adhesive to ensure bonding between the sleeve and the mandrel even if some wiping may occur during the installation. Also shown are optionally installed pins 142, which can vary in number and installed locations. In an alternative embodiment, the inside diameter of the sleeve is smaller than the maximum outside diameter of the mandrel so that the two surfaces are groove in a way that allows nesting, similar to two meshing gears. Thus, in addition to grooving the outer surface of the mandrel, the inside diameter surface 140 of the sleeve 106 that attaches to the mandrel 108 may be grooved to enhance its bond strength to the mandrel. Accordingly, at least two basic options are available when both mandrel and sleeves are grooved. One option is to have the mandrel maximum outside diameter being less than the inside diameter of the sleeve so that the grooves do not nest one within another. A second option is to nest the grooves one to another by changing the relative inside and outside diameters of the sleeve and the mandrel, which further adds strength capability to the connection.

Figure 4:
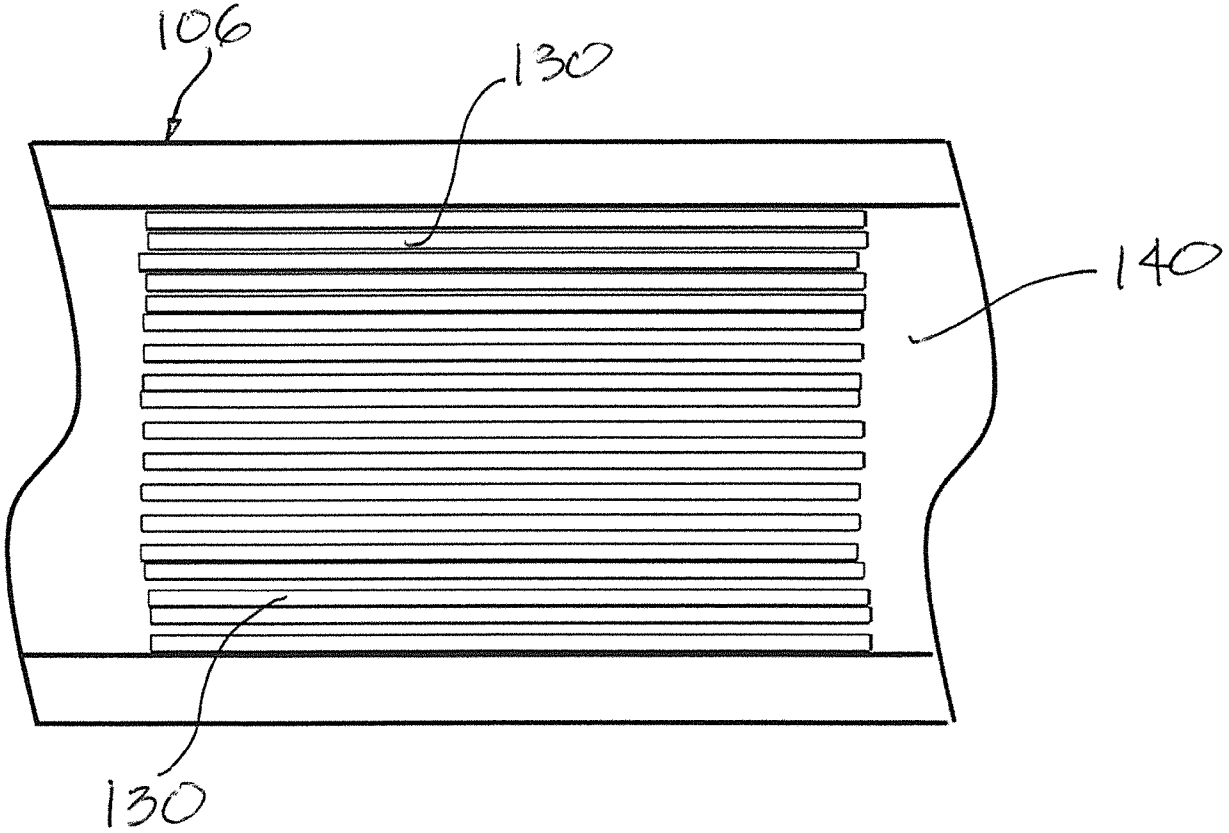
FIG. 4 is a cross-sectional side view of a sleeve provided in accordance with the system, device, and method of the present disclosure.

With reference to FIG. 4, the inside surface 140 of the disclosed sleeve 106 is provided with a plurality of grooves 130. In the example shown, the grooves 130 are each provided with the same geometry as the grooves 130 on the mandrel 108 shown in FIG. 2. In another example, the grooves 130 on the sleeve are shallower and more spaced apart from one another than the grooves on the mandrel. Thus, the connection between the sleeve and the mandrel may be such that only the inside surface of the sleeve is grooved, only the outer surface of a mandrel is grooved, or both the inside surface of the sleeve and the outside surface of the mandrel are grooved to enhance the bond strength between the two structures. When both the mandrel and the sleeve are grooved, the two respective grooves can mesh or can be spaced from one another (i.e., no nesting between the grooves). In an example, the bore of the sleeve is machined to form a plurality of grooves 130 using the same machining method described above for machining the outside surface of the mandrel.

Figure 5:
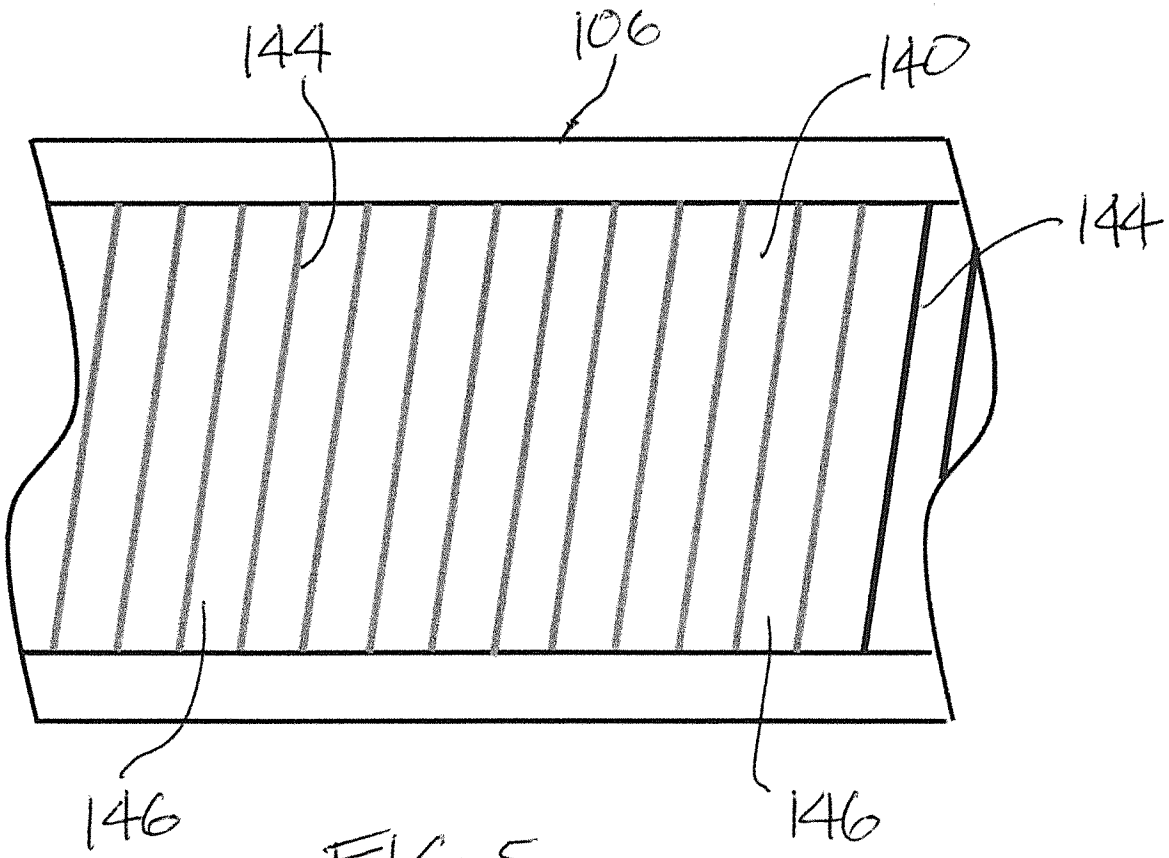
FIG. 5 is an alternative cross-sectional side view of a sleeve provided in accordance with the system, device, and method of the present disclosure.

In another alternative embodiment, one or more blown roving strands can be used as the inner layers of the sleeve for use with a splined or grooved mandrel 108. Blown roving strands comprise fiberglass roving with varying lengths of filaments such that the strand bundle has filament loops that bridge across between rovings and/or layers of rovings. With reference to FIG. 5, a sleeve 106 is shown in cross-section showing the inside surface 140 of the sleeve. In an example, blown roving strands 144 are filament wound at a low angle, such as 9 degrees, to the axis of the winding mandrel to form part of an inner-most layer of the sleeve. In other examples, the strands can be filament wound at angles of between 0 and 15 degrees. It is desirable to have the orientation of the blown roving strands generally along the axis of the mandrel to achieve a high strength connection between the sleeve and mandrel.

When the inside surface of the sleeve 140 is grit blasted for bonding preparation, the resin used to bond the strands is abraded and the blown roving strands are left intact creating undulating and grooved surfaces 146 that are suitable for bonding. The combination of a spun roving sleeve 106 and a splined mandrel 108 provides a sleeve to mandrel adhesive connection that is about 20% stronger than what can be achieved using conventional materials and methods. In some examples, blown roving strands may also be formed as outer layers of a mandrel and then subsequently grit blasted to form undulating surfaces to enhance bonding with a sleeve.

As understood from the present disclosure, the configuration, system and method are provided for use as a downhole tool. In an exemplary embodiment, the downhole tool comprises a mandrel and a sleeve and wherein the mandrel, the sleeve, or both have grooved surfaces to facilitate bonding with enhanced shear strength. A further aspect of the present disclosure is a method for forming a downhole tool comprising forming splines on a mandrel, a sleeve or both. When the sleeve is joined to the mandrel, the splines provide pockets for accommodating more adhesive than comparable prior art devices without the splines. In one example, the splines are formed by machining. In another example, the splines are formed by winding strands during formation of the sleeve and/or the mandrel and then subsequently grit blasting the cured adhesive to form undulating surfaces or grooves. Grit blasting the mandrel and the sleeve will roughen up the area between the splines to better receive adhesive. The parts are then assembled together and the adhesive is allowed to cure. Standard adhesive bonding practices may be used even though the parts are splined.

Although limited embodiments of the downhole tools and components for the downhole tools have been specifically described and illustrated herein, many modifications and variations will be apparent to those skilled in the art. Accordingly, it is to be understood that the downhole tools and the components for downhole tools constructed according to principles of the disclosed device, system, and method may be embodied other than as specifically described herein. The disclosure is also defined in the following claims.

What is claimed is:

1. A method for increasing adhesive bond strength of a composite sleeve to a mandrel comprising a longitudinal axis, said method comprising:

machining a plurality of grooves on an exterior surface of the mandrel along the longitudinal axis of the mandrel to form a plurality of axial grooves;

applying adhesive to the plurality of axial grooves; and placing the sleeve over the mandrel.

2. The method of claim 1, wherein the mandrel is made from a composite material.

3. The method of claim 1, further comprising machining an inside surface of the sleeve with a plurality of grooves prior to placing the sleeve over the mandrel.

4. The method of claim 1, wherein the plurality of axial grooves on the mandrel are equally spaced around the exterior surface.

5. The method of claim 1, further comprising a ball seat at a first end of the mandrel.

6. The method of claim 1, wherein the plurality of axial grooves each has a dimension of about 0.040 inches wide.

7. The method of claim 1, wherein the plurality of axial grooves each has a dimension of about 0.060 inches deep.

8. A method for enhancing lap shear strength of an adhesive bond between a composite sleeve and an elongated mandrel comprising a bore; said method comprising:

machining a plurality of grooves on an exterior surface of the mandrel along a longitudinal axis of the mandrel to form a plurality of axial grooves, each of said plurality of axial grooves comprising a bottom surface, two sidewalls, a groove depth, and a groove width;

applying adhesive to the plurality of axial grooves; and placing the composite sleeve over the mandrel and providing a clearance between an inside surface of the sleeve and the exterior surface of the mandrel.

9. The method of claim 8, further comprising forming a hole through the mandrel and a hole through the sleeve, aligning the hole in the sleeve with the hole in the mandrel, and placing a pin through the aligned holes.

10. The method of claim 8, wherein the composite sleeve comprises a bore defining an interior surface comprising one or more blown fiberglass roving strands.

11. The method of claim 8, wherein the mandrel is made from a composite material.

12. The method of claim 8, further comprising placing a slip back up ring and a slip wedge onto the mandrel.

13. The method of claim 8, wherein the adhesive extends beyond a first layer of fibers on the exterior surface of the mandrel along a length of at least four grooves.

14. The method of claim 8, wherein the grooves each has a dimension of about 0.040 inches wide and about 0.060 inches deep.

15. A composite high strength structure comprising:

a composite mandrel comprising an elongated body comprising a length, an exterior surface, and a bore comprising an interior bore surface;

a composite sleeve comprising an elongated body comprising a length, an exterior surface, and a bore comprising an interior bore surface placed over at least part of the exterior surface of the mandrel and defining an overlapped section;

a plurality of spaced apart grooves located at the overlapped section, each of said groove comprising a length, a width, and a depth; and cured adhesive located in the plurality of spaced apart grooves.

16. The composite high strength structure of claim 15, further comprising a slip back up ring, a slip wedge, and a packer ring located on the exterior surface of the mandrel.

17. The composite high strength structure of claim 15, wherein the plurality of grooves are provided on the mandrel by machining the mandrel and on the sleeve by machining the interior bore surface of the sleeve.

18. The composite high strength structure of claim 17, wherein the plurality of grooves on the mandrel and the plurality of grooves on the sleeve have different width, different depth, or both.

19. The composite high strength structure of claim 15, further comprising at least one hole on the mandrel aligned with at least one hole on the sleeve and wherein a pin is located in the aligned holes.

20. The composite high strength structure of claim 15, further comprising blown roving strands providing on the interior bore surface of the sleeve.

* * * * *